US009750280B2

(12) United States Patent
Parsons

(10) Patent No.: US 9,750,280 B2
(45) Date of Patent: Sep. 5, 2017

(54) PH-STABILIZED ORAL TOBACCO COMPOSITION

(71) Applicant: JT International S.A., Geneva (CH)

(72) Inventor: Rory Parsons, Ballymena (IE)

(73) Assignee: JT International S.A., Geneva (CH)

( * ) Notice: Subject to any disclaimer, the term of this patent is extended or adjusted under 35 U.S.C. 154(b) by 195 days.

(21) Appl. No.: 14/395,321

(22) PCT Filed: Apr. 18, 2013

(86) PCT No.: PCT/EP2013/058039
§ 371 (c)(1),
(2) Date: Oct. 17, 2014

(87) PCT Pub. No.: WO2013/156544
PCT Pub. Date: Oct. 24, 2013

(65) Prior Publication Data

US 2015/0114413 A1 Apr. 30, 2015

(30) Foreign Application Priority Data

Apr. 20, 2012 (EP) ..... 12164877

(51) Int. Cl.
*A24B 13/00* (2006.01)
*A24B 15/10* (2006.01)
*A24B 15/28* (2006.01)
*A24B 15/42* (2006.01)

(52) U.S. Cl.
CPC ..... *A24B 13/00* (2013.01); *A24B 15/10* (2013.01); *A24B 15/28* (2013.01); *A24B 15/42* (2013.01)

(58) Field of Classification Search
USPC ..... 131/347, 352
See application file for complete search history.

(56) References Cited

U.S. PATENT DOCUMENTS 4,136,163 A * 1/1979 Watson ..... A23G 3/36 424/43
4,606,357 A * 8/1986 Dusek ..... A24B 15/16 131/359
6,110,495 A * 8/2000 Dam ..... A23G 3/36 424/441
7,665,471 B2 * 2/2010 Mallmann ..... A01H 5/12 131/347
7,810,507 B2 * 10/2010 Dube ..... A24B 13/00 131/352

(Continued)

OTHER PUBLICATIONS

Sodium Phosphate, Med-Health.net, No Date, [online], Retrieved from the Internet, [retrieved Jul. 22, 2016], <URL: http://www.med-health.net/Sodium-Phosphate.html>.*

(Continued)

*Primary Examiner* — Dennis Cordray
(74) *Attorney, Agent, or Firm* — Nutter McClennon & Fish LLP

(57) ABSTRACT

Disclosed is a pH-stabilized oral tobacco composition comprising a buffer of at least two pH stabilizing substances comprising potassium carbonate and at least one additional pH stabilizing substance that can maintain a low total drop in pH-value over prolonged time at ambient as well as refrigerated temperature, so that the freshness and shelf life of the oral tobacco composition can be improved.

10 Claims, 2 Drawing Sheets

(a)

(b)

(56) References Cited

U.S. PATENT DOCUMENTS

| | | | | |
|---|---|---|---|---|
| 7,861,728 | B2 * | 1/2011 | Holton, Jr. | A24B 13/00 131/352 |
| 8,061,362 | B2 * | 11/2011 | Mua | A24B 15/12 131/299 |
| 8,613,285 | B2 * | 12/2013 | Fuisz | A24B 3/18 131/347 |
| 2008/0173317 | A1 | 7/2008 | Robinson et al. | |
| 2010/0247612 | A1 * | 9/2010 | Fuisz | A23L 1/22025 424/443 |
| 2010/0294292 | A1 * | 11/2010 | Hodin | A24B 13/00 131/359 |
| 2012/0039981 | A1 * | 2/2012 | Pedersen | A61K 9/0058 424/440 |
| 2012/0046354 | A1 * | 2/2012 | Ehrenpreis | A61K 31/07 514/458 |
| 2012/0055494 | A1 * | 3/2012 | Hunt | A24B 13/00 131/275 |
| 2012/0073589 | A1 | 3/2012 | Kawata et al. | |
| 2014/0144429 | A1 * | 5/2014 | Wensley | A61M 15/06 128/200.14 |

OTHER PUBLICATIONS

Glycine, New World Encyclopedia, pp. 1-5, No Date, [online], Retrieved from the Internet, [retrieved Jul. 22, 2016], <URL: http://www.newworldencyclopedia.org/entry/Glycine>.*

Glutamic acid, New World Encyclopedia, pp. 1-7, No Date, [online], Retrieved from the Internet, [retrieved Jul. 22, 2016], <URL: http://www.newworldencyclopedia.org/entry/Glutamic_acid>.*

"Sodium Phosphate, Tribasic". Hawley's Condensed Chemical Dictionary. (2007), [online], Retrieved from the Internet, [retrieved Jul. 22, 2016], <URL: http://onlinelibrary.wiley.com/doi/10.1002/9780470114735.hawley14852/full>.*

"Magnesium Trisilicate". Hawley's Condensed Chemical Dictionary. (2007), [online], Retrieved from the Internet, [retrieved Jul. 22, 2016], <URL:http://onlinelibrary.wiley.com/doi/10.1002/9780470114735.hawley10166/abstract>.*

"Sodium Glutamate". Hawley's Condensed Chemical Dictionary. (2007), [online], Retrieved from the Internet, [retrieved Jul. 22, 2016], <URL:http://onlinelibrary.wiley.com/doi/10.1002/9780470114735.hawley14763/full>.*

"Potassium Glutamate". Hawley's Condensed Chemical Dictionary. (2007), [online], Retrieved from the Internet, [retrieved Jul. 22, 2016], <URL:http://onlinelibrary.wiley.com/doi/10.1002/9780470114735.hawley13312/full>.*

"Glycine". Hawley's Condensed Chemical Dictionary. (2007), [online], Retrieved from the Internet, [retrieved Jul. 22, 2016], URL: http://onlinelibrary.wiley.com/doi/10.1002/9780470114735.hawley07928/full>.*

International Search Report for PCT/EP2013/058039, mailed Jul. 22, 2013 (3 pages).

Written Opinion for for PCT/EP2013/058039, mailed Jul. 22, 2013 (5 pages).

* cited by examiner (a)

(b)

PH-STABILIZED ORAL TOBACCO COMPOSITION

The present invention relates to a pH-stabilized oral tobacco composition that can maintain a low total drop in pH-value over prolonged time, thus improving the freshness and shelf life of the oral tobacco composition.

PRIOR ART

Retaining an oral tobacco product as close as possible to its "just made" condition over shelf life is desirable to improve consumer perception of product freshness. In particular, improving the pH stability of oral tobacco products is one important research area in the field of oral tobacco products, as it is known that the pH of an oral tobacco product drops with time due to natural chemical and biochemical processes. The nature of dry or moist oral tobacco products (often called snuff) demands that the product is maintained at a sufficiently high and fairly constant pH during the entire storage period. The pH stability is particularly important in moist products as the pH decreases more rapidly in those compared to the corresponding dry products.

A pH regulation in oral tobacco products is needed to provide the desired sensory characteristics and also to have a contributory influence on microbial growth inhibition.

In a general oral tobacco product, and in particular in moist ones, the pH of the moist product starts to drop a few days after production, albeit slowly at the recommended storage temperature (approximately <8° C.). Storage at room temperature may accelerate pH decline, which is temperature dependent.

The problem can be solved be adding soda, for example to a pH value just below 9. A more basic pH value could potentially cause irritation to the user. Also, refrigeration may slow down the processes leading to a decrease in pH. However, these two methods are not sufficient to provide an adequate stability of the pH during storage.

Many different approaches have been taken to improve the pH stability of an oral tobacco product in recent years.

EP 1 575 384 B1 discloses a non-chewable tobacco composition for use in the oral cavity between the lip/cheek and gums comprising tobacco and a carrier, wherein the composition is easily formable whereby it adjusts its form during use in the oral cavity. The composition of EP 1 575 384 B1 is intended for improving the taste and sensory characteristics of the consumer. While a pH control is mentioned in this document, the long-time suppression of a pH-change is not tackled.

A smokeless tobacco product configured for insertion into the mouth of a user which also contains pH adjusters is described in U.S. Pat. No. 7,810,507 B2. The long-time pH stability of the mixture is not assessed in this document.

WO 2009/082331 A1 discloses a tobacco product or a non-tobacco snuff product comprising a magnesium carbonate, for conferring pH stability. A disadvantage of using magnesium carbonate is that the initial pH of a product is only slowly adjusted as magnesium carbonate is only poorly soluble in water, thus prolonging production times.

WO 2011/122567 A1 describes an oral tobacco material that contains an acid salt of phosphoric acid and a basic salt of carbonic acid as pH adjustors.

Accordingly, there is still a demand for oral tobaccos having improved pH stability over a long period of time.

SUMMARY OF THE INVENTION

The present invention provides an oral tobacco composition that can be easily manufactured to have a sufficient starting pH and can maintain a sufficient pH over a prolonged time, thus solving the above mentioned problems. In certain embodiments, the pH in the oral tobacco product can be maintained with a combination of two or more pH stabilizing substances which both are approved as food additives to oral tobacco products, for example by the European Food Safety Authority.

In one aspect, the present invention provides an oral tobacco composition comprising a buffer of at least two pH stabilizing substances comprising potassium carbonate and at least one additional substance, characterized in that the total pH drop after 17 weeks at 18 to 25° C. is less than 0.7.

In addition, the present invention also provides an oral tobacco product comprising the oral tobacco composition, as well as a method of preparing a pH stabilized oral tobacco product, comprising the steps of providing an oral tobacco product; and adding a buffer of at least two pH stabilizing substances comprising potassium carbonate and at least one additional pH stabilizing substance.

In another embodiment, the present invention also provides the use of a compound selected from trisodium phosphate, magnesium trisilicate, glycine, glutamic acid, and sodium and potassium salts of glycine or glutamic acid as a pH-stabilizing substance in an oral tobacco composition.

Further preferable aspects of the present oral tobacco composition and the present method will become evident from the dependent claims.

DEFINITIONS

Room temperature, or ambient temperature, as used for the present invention, is a temperature in the range of 18 to 25° C.

Refrigerated temperature within the scope of the present invention is a temperature of less than 8° C., preferably between 0 and 6° C., further preferably between 3 and 5° C.

The total pH drop of the oral tobacco composition is the change of the pH during storage, i.e. the difference between the initial pH and the pH after n weeks, with n being a positive number, preferably a positive integer.

As a measure of pH drop was required, a simple weekly pH change was chosen (multiplied by 1000 for ease of comparison) as average pH drop, which can be calculated as follows:

$$\text{Average pH drop} = 1000 \times (\text{initial pH} - \text{pH after } n \text{ weeks})/n$$

The initial pH of the oral tobacco composition (sometimes also referred to as starting pH) is the pH directly after the manufacture of the oral tobacco composition before storage after the addition of all additives, i.e. after addition of the at least two buffer substances, where applicable, and other additives.

The stability improvement of the pH refers to the difference between the pH drop of a sample compared to a control sample.

An oral tobacco product in the present invention includes snus, American snuff, tobacco-based gums/tablets/strips, nasal snuff as well as inhaled tobacco products that are not burnt.

For the application, the unit % refers to % by weight, unless noted otherwise.

DETAILED DESCRIPTION

Figure 1:
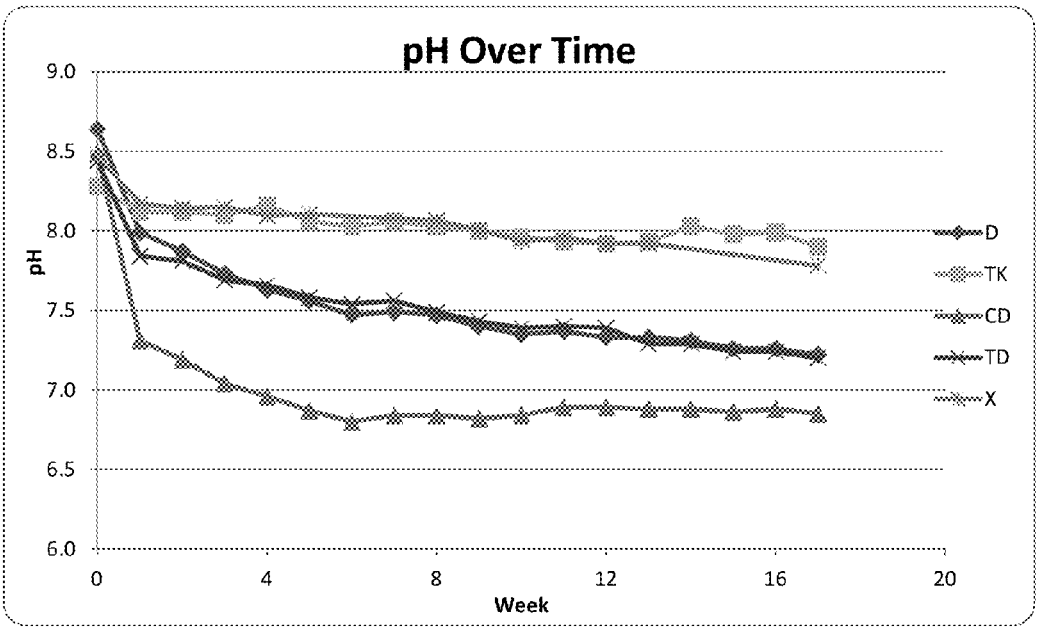
FIG. 1 shows the change in the pH-values for the samples from Examples 1 and 2.
Figure 1:
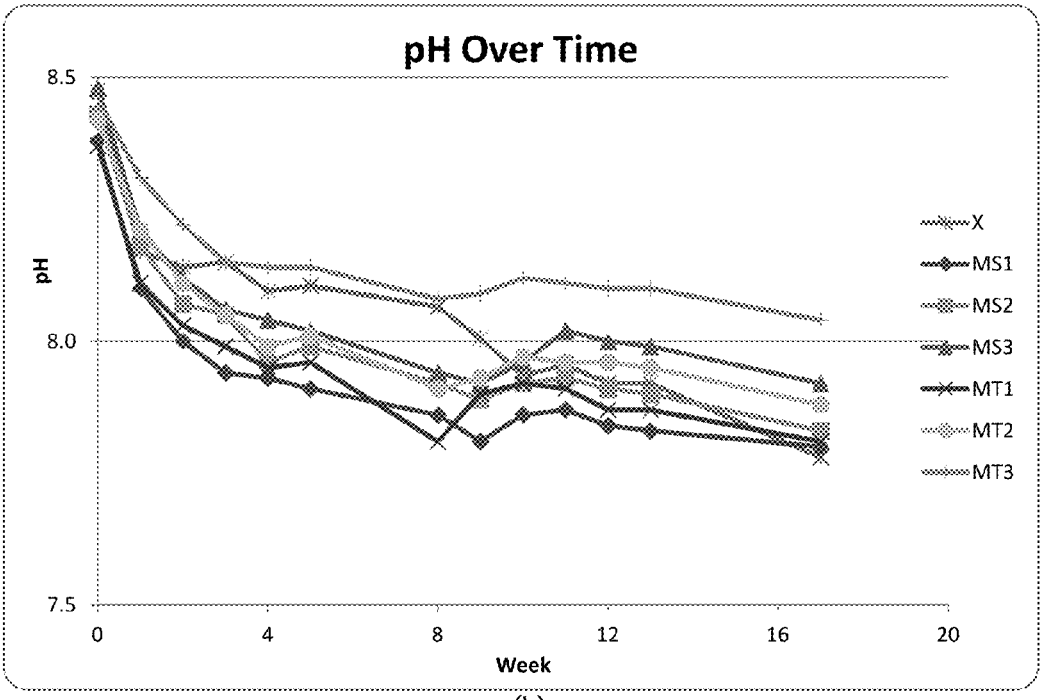

The buffer of the present oral tobacco composition comprises at least two buffer substances, one of which is potassium carbonate. Potassium carbonate enables a fast adjustment of the initial pH of the oral tobacco composition, preferably to an initial pH in the range between 7 and 10, more preferably between 7 and 9, further preferably between 8 and 9 and particularly preferably larger than 8. It is more soluble than sodium carbonate which is often used in other oral tobacco compositions and therefore can be more readily added to tobacco blend in solution form. This eases the manufacturing process. In comparison to substances like magnesium carbonate, which only are poorly soluble in water, the pH-adjustment with potassium carbonate also is faster. Thus, in certain embodiments, the initial pH of the oral tobacco composition is between 7 and 10.

The oral tobacco composition enables a total pH drop at room temperature after 17 weeks of less than 0.7, preferably equal to or less than 0.65, and further preferably equal to or less than 0.6. A higher total pH drop would not ensure a sufficient long-term stability of the oral tobacco composition, thus leading to a shorter storage shelf life. In addition, a higher total pH drop could also lead to an undesirable change of the taste of the composition due to an insufficient pH. The pH drop at refrigerated temperatures is considerably less.

In some embodiments, the total pH drop of the oral tobacco composition at refrigerated temperature after 27 weeks is less than 0.7. In certain embodiments the average pH drop rate can be less than 0.05 per week over a period of at least 17 weeks at room temperature. In some embodiments, the average pH drop rate can also be less than 0.05 per week over a period of at least 27 weeks at refrigerated temperature in addition or instead to the above pH drop rate per week over a period for at least 17 weeks at room temperature. In comparison to an oral tobacco composition comprising potassium carbonate alone the pH stability improvement can in some embodiments be at least 35%.

In certain embodiments the at least one additional pH stabilizing substance is a compound of the formula $A_aB_bO_cD_d$ or a compound derived from an amino acid, wherein A is an alkali metal ion or an alkaline earth metal ion; B is an element selected from the group consisting of P, N, C, Si, S; O is oxygen; D is H, a is an integer between 1 and 3, b is an integer between 1 and 4, c is an integer between 3 and 12, and d is an integer between 0 and 2, or a mixture thereof. Preferably A is selected from the group of Na, K, Mg, Ca, and B is preferably P, C, N or Si. More preferably A is Na, K or Mg, and B more preferably is P or Si. A compound derived from an amino acid can be the amino acid itself as well as a salt of the amino acid, preferably an alkali or alkaline earth metal salt or ammonium salt of the amino acid, further preferably an alkali metal salt of the amino acid.

It is also possible to use more than one additional pH stabilizing substance, wherein it is possible to use two or more amino acids, two or more of the compounds of the above formula $A_aB_bO_cD_d$, or mixtures of one or more compounds of the above formula $A_aB_bO_cD_d$ with one or more amino acids.

Preferred compounds of the at least one additional pH stabilizing substance are trisilicate compounds and phosphate compounds as well as compounds derived from glycine and glutamic acid, wherein preferable compounds derived from glycine and glutamic acid are glycine, glutamic acid and alkali metal salts, alkali earth metal salts and ammonium salts of glycine and glutamic acid, and especially preferred compounds are trisodium phosphate, magnesium trisilicate, glycine, glutamic acid, and sodium and potassium salts of glycine and glutamic acid, i.e. sodium glutamate, potassium glutamate, sodium glycinate and potassium glycinate. Also mixtures of the above preferred compounds of the at least one additional pH stabilizing substance can be used.

The amounts of the potassium carbonate and the at least one additional pH stabilizing substance can be set suitably by the person skilled in the art to achieve a total pH drop at a temperature in the range of 18 to 25° C. after 17 weeks of less than 0.7 and/or a total pH drop at a temperature of less than 8° C. after 27 weeks of less than 0.7 and/or an average pH drop rate of less than 0.05 per week over a period of at least 17 weeks at a temperature in the range of 18 to 25° C., and/or an average pH drop rate of less than 0.05 per week over a period of at least 27 weeks at a temperature of less than 8° C.

Preferred amounts of the potassium carbonate are between 1 and 5% by weight, based on the total weight of the oral tobacco composition.

Preferred amounts of the at least one additional pH stabilizing substance in the oral tobacco composition are between 0.5 and 20% by weight, based on the total weight of the oral tobacco composition. More preferably, between 0.5 and 10% by weight of at least one of the compound of the formula $A_aB_bO_cD_d$ and/or the at least one of the amino acid are applied in the oral tobacco composition, so that the total amount adds up to between 0.5 and 20% by weight, based on the total weight of the oral tobacco composition. The same values also apply for the preferred compounds of formula $A_aB_bO_cD_d$, i.e. trisilicate compounds and phosphate compounds, preferably trisodium phosphate and magnesium trisilicate, as well as the preferred compounds derived from amino acids. Further preferred amounts of one of the compounds of the formula $A_aB_bO_cD_d$ or one amino acid are between 0.5 and 5% by weight, and even further preferred amounts between 1 and 4% by weight.

The present invention also provides for the use of preferred compounds, selected from trisodium phosphate, magnesium trisilicate, glycine, glutamic acid, and sodium and potassium salts of glycine or glutamic acid, as a pH-stabilizing substance in an oral tobacco composition. Preferred are amounts between 0.5 to 20% by weight, more preferred amounts between 0.5 and 10% by weight, even more preferred amounts between 0.5 and 5% by weight and even further preferred amounts between 1 and 4% by weight of each of the preferred compounds trisodium phosphate, magnesium trisilicate, glycine, glutamic acid, and sodium and potassium salts of glycine or glutamic acid, respectively.

In addition to the at least two buffer substances, one of which is potassium carbonate, the oral tobacco composition comprises a tobacco and can further contain various additives in addition to the at least two buffering substances.

Any tobacco can be used for the present oral tobacco composition. Examples thereof include a mixture of stem and lamina derived from various sources and curing types.

Additives in the oral tobacco composition can be water, flavorants, binders, colorants, fillers, disintegration aids, humectants, antioxidants, oral care ingredients, preservatives, additives from herbal or botanical sources, or further additives usually used in oral tobacco products, as well as mixtures thereof. In certain embodiments, at least water is present as an additional additive.

Further disclosed is a method of preparing a pH stabilized oral tobacco product which shows a total pH drop of less than 0.7 at room temperature after 17 weeks, comprising the steps of i) providing an oral tobacco product; and ii) adding a buffer of at least two pH stabilizing substances comprising potassium carbonate and at least one additional pH stabilizing substance.

The potassium carbonate and the at least one additional pH stabilizing substance can be added in step ii) of the present method separately or in combination. Preferably the potassium carbonate is added first or potassium carbonate and the at least one additional pH stabilizing substance are added together. If the at least one additional pH stabilizing substance is added first, it's buffering capacity would be partially used up before the pH is set to a suitable initial pH value, which is not preferred.

Preferably the potassium carbonate is added in the form of a solution, as this eases the production of the oral tobacco composition. The at least one additional pH stabilizing substance is added as solution or powder.

The present invention also provides an oral tobacco product that comprises the oral tobacco composition of the invention. The oral tobacco product can be a snuff, a snus, a chewing tobacco, tobacco-based chewing gum, tobacco-based tablets or any other smokeless tobacco product A preferred product of the present invention is a snus.

EXAMPLES

The present invention will now be described in more detail in connection with exemplary embodiments which are merely presented for illustrative purpose and do not restrict the invention to these exemplary embodiments. In the examples, the unit % refers to % by weight, unless noted otherwise.

All experiments in the examples were carried out at ambient temperature. The tobacco used in the experiments was a standard snus blend containing around 30-50% by weight stem in regard to the tobacco component only. Storage of the prepared compositions was also carried out at ambient temperature in standard cans, which are 2-piece polypropylene containers as sold in Sweden.

After the production of the composition, the initial pH was measured and noted, and then pH measurements were carried out at the intervals noted in the examples.

Example 1

A single blend was prepared in a pilot plant snus blender. A pasteurization process was carried out in a manner familiar to those skilled in the art, and NaCl and propylene glycol were added at standard levels (5% and 2.5% by weight respectively). No buffer was added in the blender. This blend was used to make samples containing the buffer quantities shown in Table 1. Chemicals used in the experiments were purchased from Sigma Aldrich.

TABLE 1

Buffer values of samples in Example 1

| Sample | Code | Buffer Quantities (% in blend) | Total Buffer Quantity | pH at t = 0 |
|---|---|---|---|---|
| $K_2CO_3$ (Control) | X | 3.5% $K_2CO_3$ | 3.5% | 8.54 |
| $Na_3PO_4/K_2CO_3$ | TK | 2.5% $K_2CO_3$ & 3.2% $Na_3PO_4$ | 5.7% | 8.28 |
| $Na_2SiO_3$ | D | 3.8% $Na_2SiO_3$ | 3.8% | 8.64 |
| $CaCO_3/Na_2SiO_3$ | CD | 1.5% $CaCO_3$ & 2.7% $Na_2SiO_3$ | 4.2% | 8.49 |
| $Na_3PO_4/Na_2SiO_3$ | TD | 3.2% $Na_3PO_4$ & 2.7% $Na_2SiO_3$ | 5.9% | 8.44 |

The buffers were pre-dissolved in water before addition, and additional water was added to each sample mix to bring the final moisture to 48±2%. The samples were then packed into polypropylene/low-density polypropylene cans (plus outer labels) and stored in ambient conditions.

The pH of each sample was measured weekly at ambient temperature by adding 9 ml deionized water (checked at pH=7.0±0.2) to 1.00 g sample, shaking vigorously and then measuring on a Mettler-Toledo Seven Easy pH meter.

It was noted during this initial experiment that both alkali earth metal carbonates and sodium metasilicate appeared to have the potential to improve snus pH stability. It seemed reasonable, therefore, that alkali earth metal silicates may be worth immediate investigation, so a further experiment was started around the halfway point (15 weeks).

Example 2

Magnesium trisilicate hydrate Mg2Si3O8.xH2O (E553a; CAS No. 14987-04-3) and magnesium silicate hydrate (talc) Mg3Si4O12H2 (E553b; CAS No. 14807-96-6) were purchased from Sigma Aldrich. A blend was prepared in a similar fashion to Example 1 and this blend was used to make samples containing the buffer quantities shown in Table 2 below. Storage conditions (packaging/temperature) and pH measurement were identical to Example 1. Measures for the samples in Example 1 were continued throughout the timescale of Example 2.

TABLE 2

Buffer values of samples in Example 2

| Sample | Code | Buffer Quantities (% in blend) | Total Buffer Quantity | pH at t = 0 |
|---|---|---|---|---|
| $K_2CO_3$ (Control) | X | 3.5% $K_2CO_3$ | 3.5% | 8.41 |
| $Mg_3Si_4O_{12}H_2/K_2CO_3$ | MS1 | 3.5% $K_2CO_3$ & 1.0% $Mg_3Si_4O_{12}H_2$ | 4.5% | 8.38 |

TABLE 2-continued

Buffer values of samples in Example 2

| Sample | Code | Buffer Quantities (% in blend) | Total Buffer Quantity | pH at t = 0 |
|---|---|---|---|---|
| $Mg_3Si_4O_{12}H_2$/ $K_2CO_3$ | MS2 | 3.5% $K_2CO_3$ & 2.0% $Mg_3Si_4O_{12}H_2$ | 5.5% | 8.43 |
| $Mg_3Si_4O_{12}H_2$/ $K_2CO_3$ | MS3 | 3.5% $K_2CO_3$ & 4.0% $Mg_3Si_4O_{12}$H2 | 7.5% | 8.48 |
| $Mg_2Si_3O_8/K_2CO_3$ | MT1 | 3.5% $K_2CO_3$ & 1.0% $Mg_2Si_3O_8$ | 4.5% | 8.37 |
| $Mg_2Si_3O_8/K_2CO_3$ | MT2 | 3.5% $K_2CO_3$ & 2.0% $Mg_2Si_3O_8$ | 5.5% | 8.42 |
| $Mg_2Si_3O_8/K_2CO_3$ | MT3 | 3.5% $K_2CO_3$ & 4.0% $Mg_2Si_3O_8$ | 7.5% | 8.46 |

There was a clear variation in the pH changes of the samples, so in order to gauge the relative performance of the buffers some further analysis was necessary. The key characteristics of Examples 1 and 2—starting pH (t==) and pH stability, total pH drop and average pH drop (drop/wk) as well as pH improvement—are summarized below in Table 3.

Results are ranked in order of decreasing effectiveness, and a % improvement column is included showing the difference between the pH drop of each sample compared to the average of the 2 control samples (17 weeks ambient).

Trisodium phosphate/potassium carbonate was very effective as buffer combination. Several of the samples performed worse than the control sample. Magnesium trisilicate/potassium carbonate and magnesium silicate/potassium carbonate also had a positive effect in addition to sodium phosphate/potassium carbonate. This effect may be complimented by the anti-caking (prevents the formation of lumps easing packaging, transport and consumption) and glidant (improves a powder's flowability) properties of magnesium trisilicate and magnesium silicate which are often employed in powder processing, thus easing manufacture. Sodium phosphate, on the other hand, is a very efficient additional pH stabilizing substance that can be obtained at low cost, thus making production cheap.

The changes of the pH value over time for examples 1 and 2 can be seen in FIG. 1 (*a*) and (*b*).

Example 3

As in Example 1, a single blend was prepared in the pilot plant. The pasteurization process was carried out as in Example 1, and salt and propylene glycol were added at standard levels (5% and 2.5% respectively). No buffer was added in the blender. Sodium glutamate and the sodium salt of glycine were purchased from Sigma-Aldrich. A 10% w/w aqueous solution of each of these was prepared and the pH of each was adjusted to 9.7±1. Twelve cans of each sample type were prepared in a similar fashion to Example 1 using the quantities shown below, and all were stored in ambient conditions. The column blend refers to the tobacco blend, and the same tobacco blend was used as in Example 1.

TABLE 3

Complete pH change analysis over 17 weeks (ranked in order of pH stability)

| Sample | Code | pH @ t = 0 | pH @ 17 wks | Total pH drop | pH drop/wk ($\times 10^3$) | % Improvement |
|---|---|---|---|---|---|---|
| $Na_3PO_4$/ $K_2CO_3$ | TK | 8.28 | 7.90 | 0.38 | 22.4 | 45.7 |
| $Mg_2Si_3O8$/ $K_2CO_3$ | $MT_3$ | 8.46 | 8.04 | 0.42 | 24.7 | 40.0 |
| $Mg2Si_3O8$/ $K2CO_3$ | $MT_2$ | 8.42 | 7.88 | 0.54 | 31.8 | 22.9 |
| $Mg_2Si_3O8$/ $K_2CO_3$ | $MT_1$ | 8.37 | 7.81 | 0.56 | 32.9 | 20.0 |
| $Mg_3Si_4O_{12}H_2$/ $K_2CO_3$ | $MS_3$ | 8.48 | 7.92 | 0.56 | 32.9 | 20.0 |
| $Mg_3Si_4O_{12}H_2$/ $K_2CO_3$ | $MS_1$ | 8.38 | 7.80 | 0.58 | 34.1 | 17.1 |
| $Mg_3Si_4O_{12}H_2$/ $K_2CO_3$ | $MS_2$ | 8.43 | 7.83 | 0.60 | 35.3 | 14.3 |
| $K_2CO_3$ (Control)* | X | 8.48 | 7.78 | 0.70 | 41.2 | N/A |
| $Na_3PO_4$/ $Na_2SiO_3$ | TD | 8.44 | 7.2 | 1.24 | 72.9 | −77.1 |
| $Na_2SiO_3$ | D | 8.64 | 7.22 | 1.42 | 83.5 | −102.9 |
| $CaCO_3$/ $Na_2SiO_3$ | CD | 8.49 | 6.85 | 1.64 | 96.5 | −134.3 |

[*average of results from Part One & Part Two]

TABLE 4

Quantities used in the samples of Example 3 (given in weight %)

| Sample | Code | Blend (%) | Water (%) | Propylene glycol (%) | $K_2CO_3$ (%) | Glycine soln (%) | Glutamate soln (%) |
|---|---|---|---|---|---|---|---|
| Control | Cont. | 56.00 | 38.00 | 2.50 | 3.50 | 0.00 | 0.00 |
| Glycine/$K_2CO_3$ | Gly1 | 54.85 | 29.15 | 2.50 | 3.50 | 10.00 | 0.00 |
| Glycine/$K_2CO_3$ | Gly2 | 53.70 | 20.30 | 2.50 | 3.50 | 20.00 | 0.00 |
| Glutamate/$K_2CO_3$ | Glut1 | 54.85 | 29.15 | 2.50 | 3.50 | 0.00 | 10.00 |
| Glutamate/$K_2CO_3$ | Glut2 | 53.70 | 20.30 | 2.50 | 3.50 | 0.00 | 20.00 |

As before, a comparison of the rate of pH decline is given in Table 5 below. This allows fair comparison of the pH stability of the samples-the slower the rate of decline (pH drop/wk×$10^3$) the better the buffering system.

TABLE 5

Comparison of performance of buffer systems of Example 3

| Sample | Code | pH @ t = 0 | pH @ 19 wks | Total pH drop | pH drop/wk (×$10^3$) |
|---|---|---|---|---|---|
| Glycine/$K_2CO_3$ | Gly2 | 9.17 | 8.69 | 0.48 | 25.3 |
| Glutamic acid/$K_2CO_3$ | Glut2 | 8.52 | 7.94 | 0.58 | 30.5 |
| Glycine/$K_2CO_3$ | Gly1 | 8.91 | 8.24 | 0.67 | 35.3 |
| Glutamic acid/$K_2CO_3$ | Glut1 | 8.52 | 7.62 | 0.90 | 47.4 |
| Control | Cont | 8.47 | 7.49 | 0.98 | 51.6 |

The results in table 5 show that both glycine and glutamate can improve the pH stability of snus. Glutamate performed very well at the higher concentration (sample Glut2) with a very good starting pH and slow rate of decline.

Figure 2:
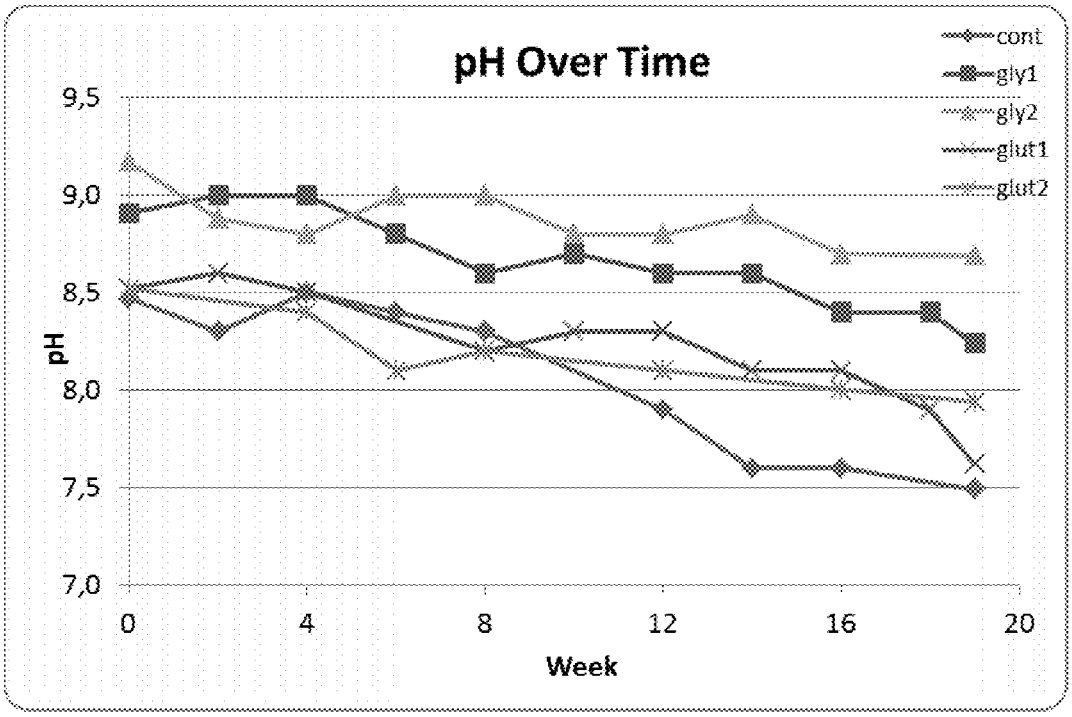
FIG. 2 shows the change in the pH-values for the samples from Example 3.

The changes of the pH value over time for example 3 can be seen in FIG. 2.

Example 3 found 2 new options for improving pH stability of snus. The potential gains for freshness and shelf life are not as great as some previously reported buffer systems (trisodium phosphate/potassium carbonate or magnesium trisilicate/potassium carbonate), but glycine and glutamate are more "organic" type additives. In addition, glycine and glutamate can be also used for giving a certain taste to the oral tobacco product in addition to the pH stabilizing effect, and therefore can be added to improve the taste of the snus at the same time.

The invention claimed is:

1. An oral tobacco composition comprising a buffer of at least two pH stabilizing substances, the buffer comprising potassium carbonate and magnesium trisilicate, wherein the total pH drop at a temperature in the range of 18 to 25° C. after 17 weeks is less than 0.7.

2. The oral tobacco composition of claim 1, wherein the total pH drop at a temperature of less than 8° C. after 27 weeks is less than 0.7.

3. The oral tobacco composition of claim 1, wherein the average pH drop rate is less than 0.05 per week over a period of at least 17 weeks at a temperature in the range of 18 to 25° C., and/or wherein the average pH drop rate is less than 0.05 per week over a period of at least 27 weeks at a temperature of less than 8° C.

4. The oral tobacco composition of claim 1, wherein the stability improvement of the pH in comparison to an oral tobacco composition comprising potassium carbonate alone is at least 35%.

5. The oral tobacco composition of claim 1, wherein the initial pH of the oral tobacco composition is in the range between 7 and 10.

6. A method of preparing a pH stabilized oral tobacco product showing a total pH drop at a temperature in the range of 18 to 25° C. after 17 weeks of less than 0.7, comprising i) providing an oral tobacco product; and ii) adding a buffer of at least two pH stabilizing substances, the buffer comprising potassium carbonate and magnesium trisilicate.

7. The method of claim 6, wherein the potassium carbonate and magnesium trisilicate are added separately or in combination.

8. The method of claim 6 or 7, wherein the potassium carbonate is added in the form of a solution.

9. The method of claim 6, wherein the magnesium trisilicate is added as solution or powder.

10. An oral tobacco product comprising the oral tobacco composition of any one of claims 1 to 5.

* * * * *